US005131587A

United States Patent [19]

Staub

[11] Patent Number: 5,131,587

[45] Date of Patent: Jul. 21, 1992

[54] COMBINED CALENDAR AND ENVELOPE ASSEMBLY

[76] Inventor: Anthony F. Staub, c/o Starwin Industries, Inc., 3387 Woodman Dr., Kettering, Ohio 45429

[21] Appl. No.: 787,230

[22] Filed: Nov. 4, 1991

[51] Int. Cl.[5] ..... B65D 27/14; B42D 5/04

[52] U.S. Cl. ..... 229/92.7; 40/121; 229/75; 283/2

[58] Field of Search ..... 40/107, 119, 121; 283/2, 3, 4; 229/75, 92.7

[56] References Cited

U.S. PATENT DOCUMENTS

| | | | |
|---|---|---|---|
| 650,597 | 5/1900 | Benedict | 229/92.7 |
| 705,607 | 7/1902 | Peterson | 283/3 |
| 800,510 | 9/1905 | Struebe | 229/75 |
| 1,019,275 | 3/1912 | Press | 40/121 |
| 1,662,906 | 3/1928 | Shedd | 40/119 |
| 2,529,367 | 11/1950 | Baumgarth | 40/121 |
| 2,626,816 | 1/1953 | Winford | 283/2 |
| 2,877,581 | 3/1959 | Woofter | 40/119 |
| 2,943,778 | 7/1960 | Paulsen | 40/119 |
| 3,845,580 | 11/1974 | Ritter et al. | 40/121 |

*Primary Examiner*—Stephen P. Garbe
*Attorney, Agent, or Firm*—Biebel & French

[57] ABSTRACT

A calendar pad intended for use to solicit donations on behalf of a specific charitable institution comprises a separate, removable sheet for each month. Each sheet includes a first portion having flaps extending along its three outer edges, and a second portion extending from the inner edge of the first portion and having no flap on any of its outer edges. On the back of each sheet, there is preprinted the name and address of the charitable institution, and the flaps along the outer edges of the first portion of the sheet are provided with adhesive coatings along their back surfaces, so that they are not visible when the sheet is in use as a calendar. Each sheet may be converted into an envelope for forwarding a donation to the charitable institution by folding the gummed flaps forward to overlie the first portion of the sheet in enclosing relation with a check, moistening the three gummed flaps, and then pressing the folded second portion of the sheet against the moistened adhesive.

2 Claims, 4 Drawing Sheets

COMBINED CALENDAR AND ENVELOPE ASSEMBLY

BACKGROUND OF THE INVENTION

The combined calendar and envelope assembly disclosed hereinafter as a preferred embodiment of the present invention was developed to provide a device for soliciting donations on behalf of a specific charitable institution.

The background of the invention included recognition of the fact that the calendars comprising separate detachable sheets for each month have been widely used as advertising media, and that for this purpose, a valuable asset of any such calendar is provided by the fact that each sheet will be viewed by the user or users on numerous occasions during each month, and that whatever advertising material is on the face of each sheet will correspondingly often be brought to the attention of the user of the calendar.

The invention was developed for use by a charitable institution to combine the advantages of the effective advertising of a monthly calendar bearing a message on behalf of a charitable institution with a convenient vehicle for forwarding a donation to that institution, as further discussed and described hereinafter.

SUMMARY OF THE INVENTION

A preferred embodiment of the invention comprises a dozen paper sheets adhered together along one edge to form a pad with the successive months reproduced on the front faces the respective sheets. In addition, each sheet carries on its front face a message on behalf of a specific charitable institution.

Each single sheet in this assembly comprises a first portion having flaps extending along three edges thereof, and a second portion extending from the other edge of the first portion and having no flap on any of its outer edges. On the back of each sheet, there is preprinted the name and address of the charitable institution, and it may also be provided with prepaid mailing insignia. Also, the flaps along the outer edges of the first portion of the sheet are provided with adhesive coatings along their back surfaces, so that they are not visible when the sheet is being used as a calendar.

Whenever a user of the calendar decides to forward a donation to the charitable institution, it is necessary only to fold the gummed flaps forward to overlie the first portion of the sheet in enclosing relation with a check or other form of donation, moisten the three gummed flaps, and then press the folded second portion of the sheet against the moistened adhesive on the three flaps. The result is a preaddressed envelope ready for mailing.

Other features, objects and advantages of the invention will be apparent from or pointed out in connection with the detailed description hereinafter of the preferred embodiment illustrated in the drawings.

BRIEF DESCRIPTION OF THE DRAWINGS

FIG. 4 shows the back of the completed envelope ready for mailing; and.

DESCRIPTION OF THE PREFERRED EMBODIMENT

Figure 1:
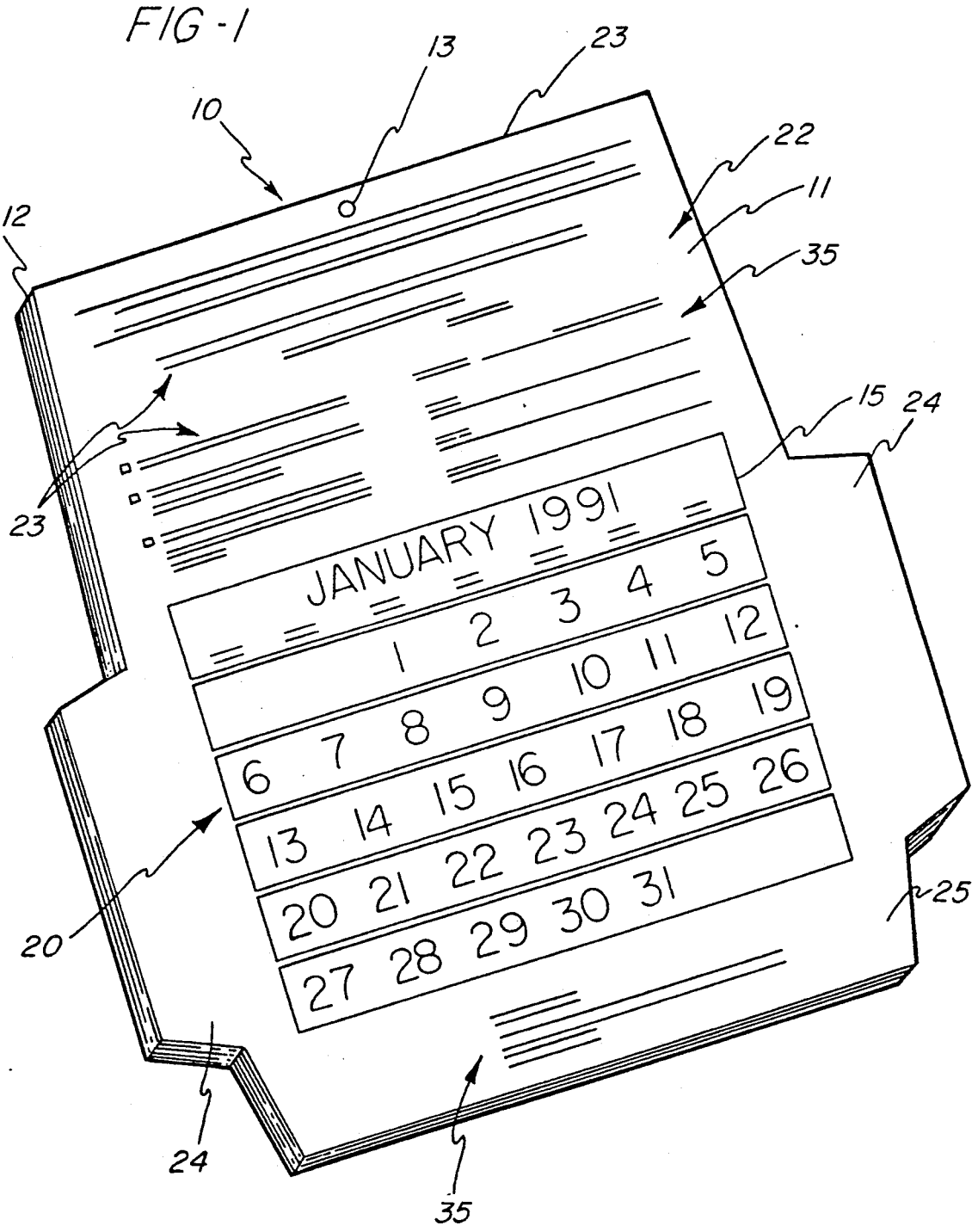
FIG. 1 shows the front face of a monthly calendar pad in accordance with the invention.
Figure 2:
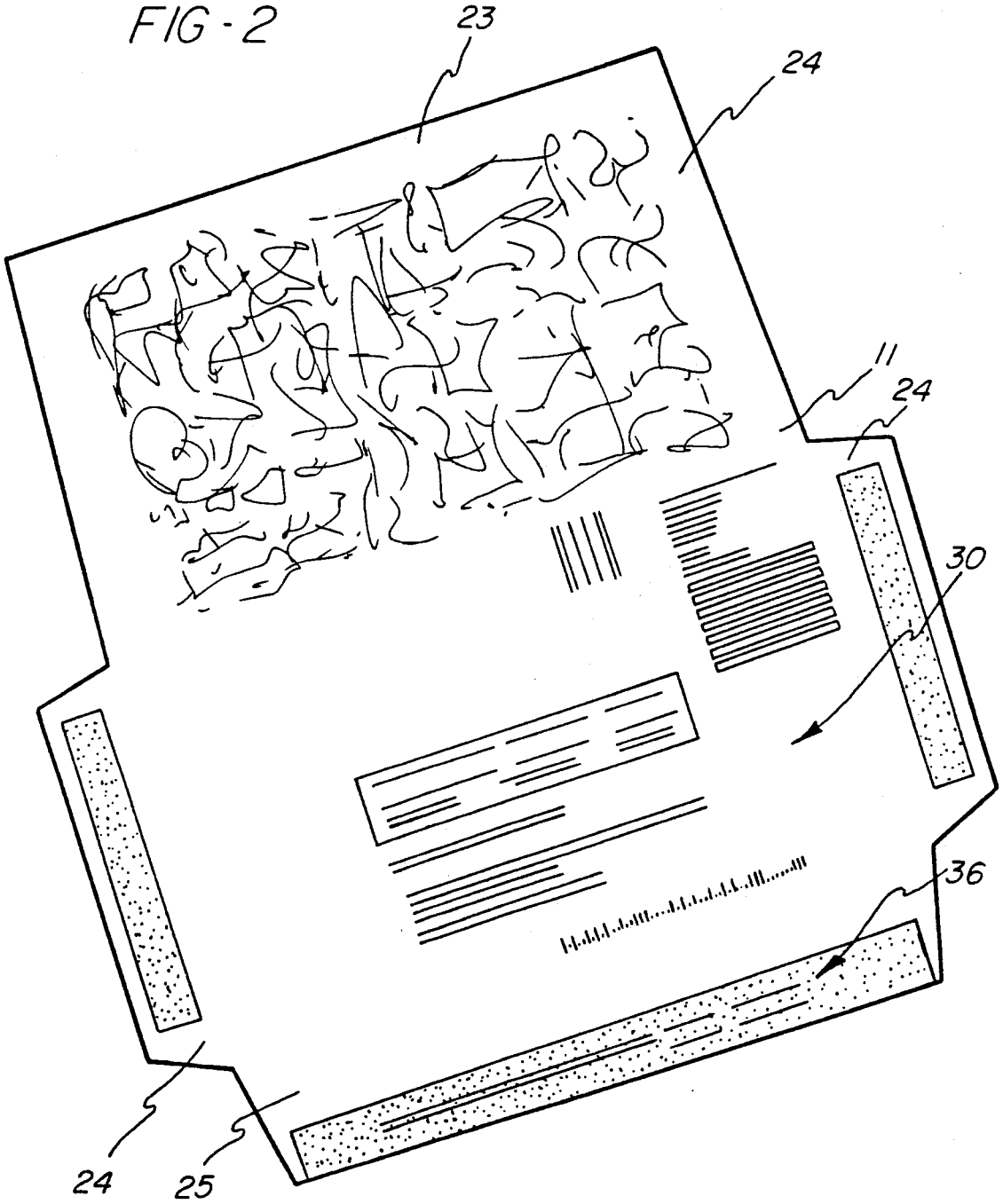
FIG. 2 is a similar view of the back face of the top sheet in FIG. 1.

In FIG. 1, the calendar pad 10 initially includes at least twelve paper sheets 11 assembled in superimposed relation and removably secured together onto the usual cardboard backing sheet by a strip of tape 12 along the top edge of the pad. A hole 13 near the top edge of the pad provides for hanging the pad on a hook or other wall support. The top sheet 11 is shown as having the calendar month of January, 1991 printed on the front face 15 thereof. The successive additional sheets have the remaining months of 1991 similarly printed thereon, and as shown in FIG. 2, a mailing address and prepaid postage information are printed at 16 on the back face 17 of each sheet 11.

The configuration of each individual sheet 11 is critical to the accomplishment of the purposes of the invention. Each sheet includes a first portion 20 occupying the lower part of the sheet, and a second portion 22 which extends from the main portion to the top edge 23 of the sheet. The first portion 20 includes a flap 24 extending along each of the side edges of the sheet and a flap 25 extending along the bottom edge of the sheet.

Each of the flaps 24 and flap 25 includes a pregummed area 26, 27 along the back face 30 of the sheet so that they are not seen and the sheet is being used as a calendar. The positions of the portions 20 and 22 could be reversed, but since the portion 20 is larger, and therefore heavier, it is preferable that it occupy the lower end of the sheets in a pad 10 to be hung on a wall. The back side of the portion 22 can advantageously be used to receive any desired printed design, as indicated at 33 in FIGS. 2 and 4, which will be seen when the sheet is converted into an envelope.

The printed month occupies the major part of the main portion 20 of the sheet, and according to the purpose of the invention, a message is printed on the auxiliary portion 22 of each sheet, as indicated diagrammatically at 35. More specifically, for the use contemplated by the invention, the information printed on the second sheet portion 22 will include, in addition to identification of a particular charitable organization, an explanation of the type and purpose of the organization and the donations requested by the organization, such for example as Help the Homeless $5 will provide 2 means for one purpose $15 will provide lodging for one night and 2 means for one person In addition, the sheet portion 22 provides space 35 for the entry of the name and address of a person using the sheet for donation purposes. This will enable the receiving organization to mail to the donor a receipt for tax purposes, as can be printed at 36 on the back of the flap 25 in FIG. 2.

Figure 3:
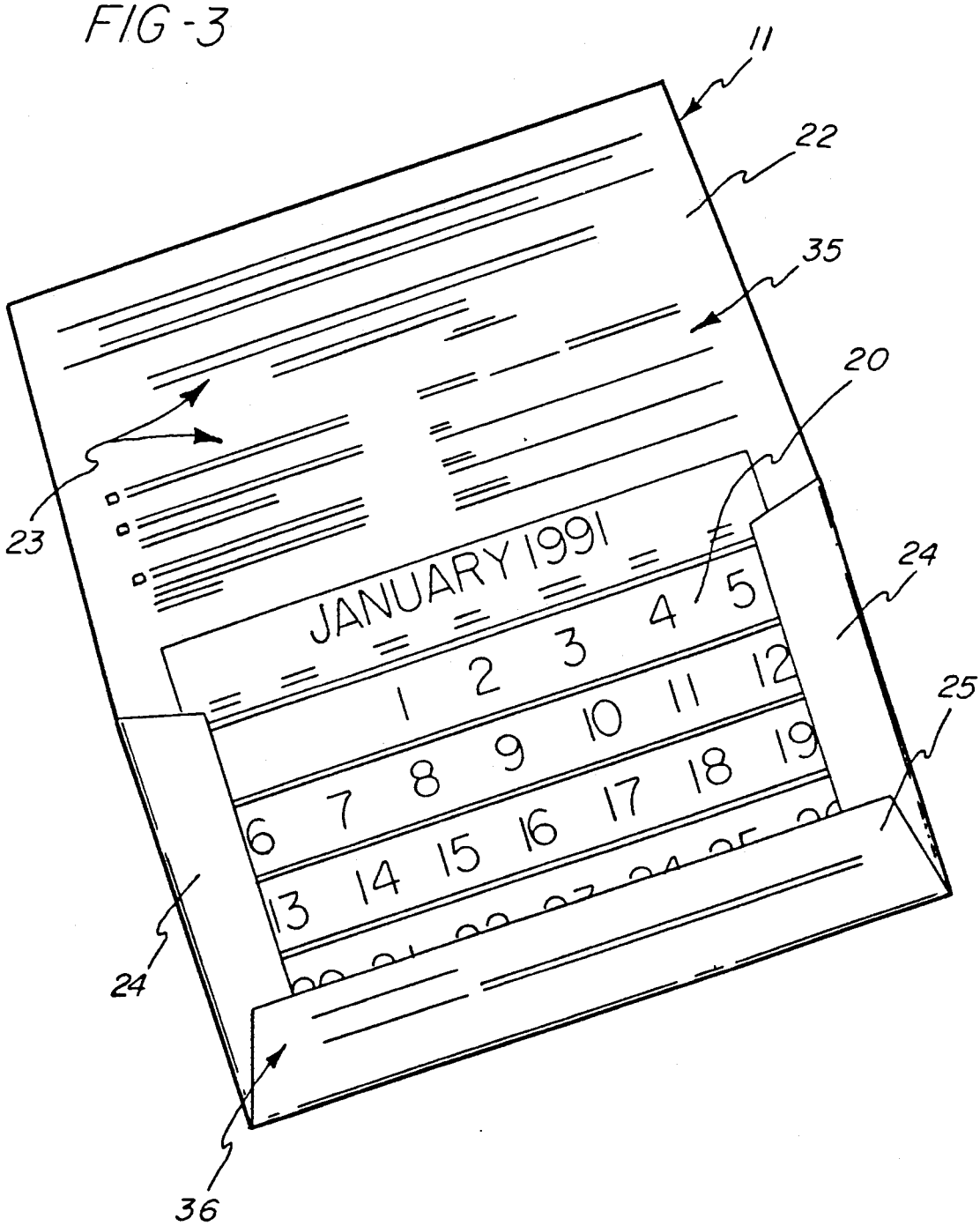
FIG. 3 shows the same sheet at an intermediate stage of its conversion into an envelope.
Figure 4:
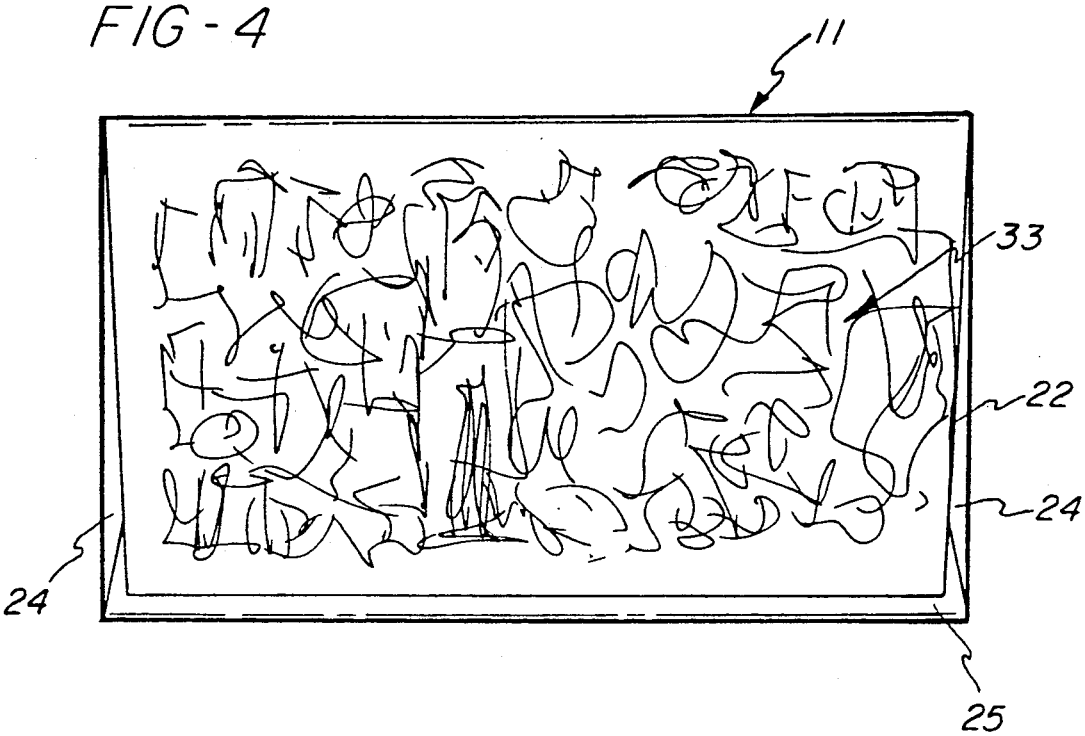
Figure 5:
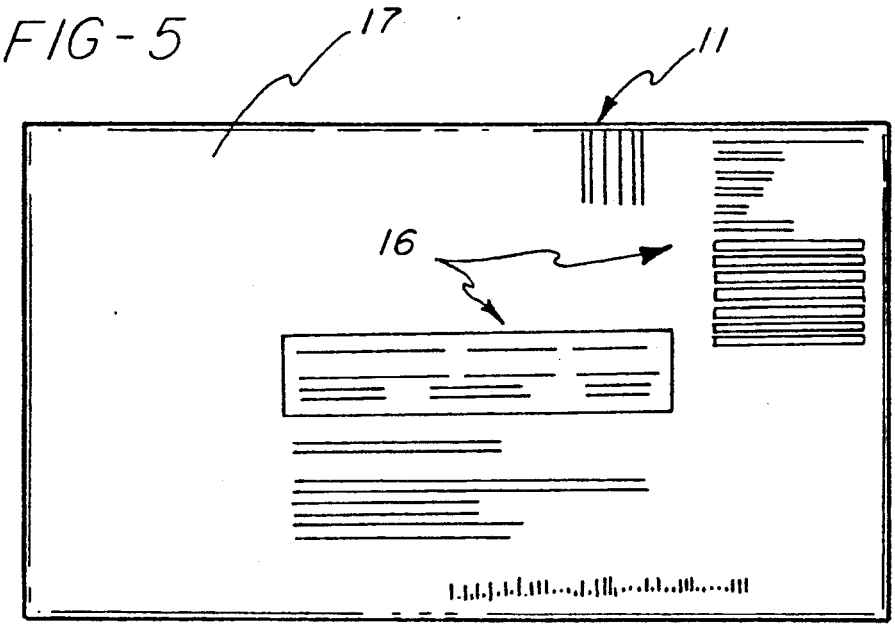
FIG. 5 shows the front of the envelope in FIG. 4.

In order to use one of the sheets 11 for its intended purpose, a donor need only fill in the appropriate blanks in the portion 22, and then convert the blank into a postage prepaid envelope, ready for mailing as shown in FIG. 4, by means of the following steps:

1. Fold the three flaps 24 and 25 toward the front face of the sheet, to the positions shown in FIG. 3;

2. Moisten all of the adhesive strips 26 and 27;
3. Place the donation on the main portion 20 of the sheet; and
4. Fold the sheet portion 22 forward and press it against the three moistened adhesive strips.

In the primary intended use for the invention, multiple calendar pads are distributed at or prior to Christmas, either by the individual charitable institution or by a benefactor of the institution, to businesses and persons who will use and display them. They will thus serve as a constant reminder of the purpose and need of the organization named thereon, and therefore as an inducement to make a donation when the month on the top sheet ends.

While the article herein described constitute preferred embodiments of the invention, it is to be understood that the invention is not limited to this precise article, and that changes may be made therein without departing from the scope of the invention which is defined in the appended claims.

What is claimed is:

1. A combined calendar and envelope comprising:

(a) a paper sheet having front and back faces and top, bottom and side edges, (b) said sheet having a calendar month reproduced on said front face thereof, (c) said sheet including a first portion adjacent one of said top and bottom edges and a second portion extending from said first portion to the other of said top and bottom edges, (d) said first portion including a flap extending along each of said side edges of said sheet and a flap extending along said adjacent top or bottom edge of said sheet, (e) said second portion being proportioned to overlie said first portion upon folding thereof to bring said top and bottom edges of said sheet together with said calendar month concealed, and (f) said flaps being gummed along said back face of said sheet and being foldable along the adjacent edges of said first portion for adhesive engagement with said front face of said folded second portion of said sheet, (g) whereby when said sheet is displayed as a calendar, said gummed faces of said flaps are not visible.

2. A combined calendar and envelope assembly comprising:

(a) a plurality of stacked paper sheets each having a front and a back face, and each having top, bottom and side edges, (b) means securing said sheets together along said top edges thereof with said front faces outermost, (c) said sheets having the successive calendar months reproduced on said front faces thereof respectively, (d) each of said sheets including a first portion adjacent said bottom edge thereof and a second portion extending from said first portion to said top edge thereof, (e) said first portion of each said sheet including a flap extending along each of said side edges of said sheet and another flap extending along said bottom edge of said sheet, (f) said second portion of each said sheet being proportioned to overlie said first portion thereof upon folding of said sheet to bring said top and bottom edges of said sheet together with said calendar month concealed by said second sheet portion, and (g) said flaps being gummed along said back face of said sheet and being foldable along the adjacent edges of said first portion for engagement with said front face of said folded second portion of said sheet, (h) whereby when said pad is displayed as a calendar, said gummed faces of said flaps are not visible.

* * * * *